US011746584B2

(12) United States Patent
Ikeler et al.

(10) Patent No.: US 11,746,584 B2
(45) Date of Patent: Sep. 5, 2023

(54) REMOTE MONITORING AND CONTROL OF MOVEABLE BARRIER IN JACKSHAFT DOOR OPERATOR SYSTEM

(71) Applicant: GMI Holdings, Inc., Mt. Hope, OH (US)

(72) Inventors: Tim Ikeler, Melbourne, FL (US); LeRoy G. Krupke, Carrollton, TX (US); Brent Buescher, Wooster, OH (US); Brent A. Rauscher, Keller, TX (US); Gregory D. Matias, Copley, OH (US); Michael Dragomier, North Canton, OH (US); Robert E. Thomas, Jr., Flower Mound, TX (US); Daniel Punchak, Wadsworth, OH (US); Robert Merwin, Wooster, OH (US); Jerry B. Chrane, Argyle, TX (US)

(73) Assignee: GMI Holdings, Inc., Mount Hope, OH (US)

( * ) Notice: Subject to any disclaimer, the term of this patent is extended or adjusted under 35 U.S.C. 154(b) by 217 days.

(21) Appl. No.: 16/855,482

(22) Filed: Apr. 22, 2020

(65) Prior Publication Data

US 2020/0340288 A1 Oct. 29, 2020

Related U.S. Application Data

(60) Provisional application No. 62/838,052, filed on Apr. 24, 2019.

(51) Int. Cl.

| | |
|---|---|
| ***H04H 20/71*** | (2008.01) |
| ***G07C 9/00*** | (2020.01) |
| ***E05F 15/77*** | (2015.01) |

(52) U.S. Cl.

CPC ..... *E05F 15/77* (2015.01); *E05Y 2400/40* (2013.01); *E05Y 2400/44* (2013.01); *E05Y 2400/66* (2013.01); *E05Y 2400/814* (2013.01); *E05Y 2400/822* (2013.01); *E05Y 2400/85* (2013.01); *E05Y 2900/106* (2013.01)

(58) Field of Classification Search

CPC ..... E05F 15/77; E05F 15/79; E05F 15/60; G08C 17/00; G08B 5/36; E05Y 2900/106

See application file for complete search history.

(56) References Cited

U.S. PATENT DOCUMENTS

| | | | |
|---|---|---|---|
| 3,262,105 | A | 7/1966 | Bell |
| 3,621,354 | A | 11/1971 | Fawcett |

(Continued)

FOREIGN PATENT DOCUMENTS

| | | | |
|---|---|---|---|
| CH | 707464 | A2 | 7/2014 |
| WO | 2006066213 | A2 | 6/2006 |

*Primary Examiner* — Hai Phan
*Assistant Examiner* — Son M Tang
(74) *Attorney, Agent, or Firm* — Haynes and Boone, LLP

(57) ABSTRACT

A garage door status monitoring and control system for a jackshaft operator may include a control module comprising a programmable platform configured to: receive a change-door-status command to change a position of a door; in response to the change-door-status command, generate and communicate a light or sound command to a wireless controller; delay a period of time after communicating the light or sound command to the wireless controller; and only after the delay, generate a door command corresponding to said change-door-status command to change the position of the door.

21 Claims, 7 Drawing Sheets

(56) References Cited

U.S. PATENT DOCUMENTS 4,144,552 A * 3/1979 Sibalis ..... H03K 17/292 327/401
4,245,298 A 1/1981 Slater
4,338,553 A 7/1982 Scott, Jr.
5,039,925 A 8/1991 Schap
5,245,264 A 9/1993 Helgren
5,578,085 A 11/1996 Groombridge
5,803,149 A 4/1998 Siegler et al.
5,770,934 A 6/1998 Theile
5,790,398 A * 8/1998 Horie ..... G06F 15/161 700/4
5,869,940 A 2/1999 Parsadayan
5,929,580 A 7/1999 Mullet et al.
6,034,497 A 3/2000 Tamagawa et al.
6,107,765 A 8/2000 Fitzgibbon et al.
6,229,276 B1 5/2001 Fitzgibbon et al.
6,246,196 B1 6/2001 Fitzgibbon et al.
6,326,751 B1 12/2001 Mullet et al.
6,346,889 B1 * 2/2002 Moss ..... G08B 13/08 340/545.1
6,376,832 B1 4/2002 Smith et al.
6,469,464 B1 * 10/2002 McCall ..... E05F 15/79 318/434
6,495,983 B1 12/2002 Stern
6,528,961 B1 3/2003 Fitzgibbon et al.
6,657,409 B1 12/2003 Leivenzon et al.
6,667,591 B2 12/2003 Mullet et al.
6,683,431 B2 1/2004 Fitzgibbon et al.
6,696,806 B2 2/2004 Study et al.
6,741,052 B2 5/2004 Fitzgibbon
6,744,231 B2 6/2004 Fitzgibbon et al.
6,782,662 B2 8/2004 McCartney et al.
6,806,665 B2 10/2004 Fitzgibbon et al.
6,847,178 B2 1/2005 Fitzgibbon
6,870,334 B2 3/2005 Jurado et al.
6,873,127 B2 3/2005 Murray
6,897,630 B2 5/2005 Murray et al.
6,940,240 B2 9/2005 Kelkhoff et al.
6,980,117 B1 * 12/2005 Kirkland ..... G08B 13/08 340/5.7
6,989,767 B2 1/2006 Fitzgibbon et al.
6,995,533 B2 2/2006 Fitzgibbon et al.
6,998,977 B2 2/2006 Gregori et al.
7,017,302 B2 3/2006 Brookbank et al.
7,019,478 B2 3/2006 Gregori et al.
7,034,486 B1 4/2006 McMahon
7,034,487 B1 4/2006 Murphy et al.
7,038,409 B1 * 5/2006 Mullet ..... E05F 15/668 318/280
7,071,813 B2 7/2006 Fitzgibbon
7,075,256 B2 7/2006 Murray
7,116,072 B1 10/2006 Murray et al.
7,119,509 B1 10/2006 Keller et al.
7,127,847 B2 10/2006 Fitzgibbon et al.
7,132,813 B2 11/2006 Gregori et al.
7,154,377 B2 12/2006 Gregori
7,173,389 B1 2/2007 Gagnon
7,180,260 B2 2/2007 Murphy et al.
7,224,275 B2 5/2007 Fitzgibbon
7,298,107 B2 11/2007 McMahon
RE40,001 E 1/2008 Siegler et al.
7,339,336 B2 3/2008 Gregori
7,405,530 B2 7/2008 Keller, Jr.
7,468,676 B2 * 12/2008 Styers ..... G08B 13/19656 340/686.1
7,600,550 B2 * 10/2009 Mays ..... G07C 9/00309 160/188
7,679,301 B2 3/2010 Gregori et al.
7,805,977 B2 10/2010 Study
8,113,263 B2 2/2012 Reed et al.
8,122,645 B2 2/2012 Theile et al.
8,421,591 B2 * 4/2013 Karasek ..... G07C 9/00182 340/5.71
8,587,404 B2 * 11/2013 Laird ..... E05F 15/684 340/5.7
8,813,429 B2 8/2014 Skotty
9,051,768 B2 6/2015 Krupke et al.
9,103,149 B2 8/2015 Skotty
9,122,254 B2 * 9/2015 Cate ..... G05B 19/042
9,208,629 B2 * 12/2015 Saladin ..... H04W 4/02
9,217,283 B2 12/2015 Olmsted
9,507,335 B2 * 11/2016 Wilder ..... E05D 15/242
9,734,645 B2 * 8/2017 Farber ..... G07C 9/28
10,540,889 B2 * 1/2020 Ikeler ..... E05F 15/77
10,733,823 B2 * 8/2020 Scalisi ..... G07C 9/00309
10,968,676 B2 4/2021 Buescher et al.
2003/0029579 A1 * 2/2003 Mays ..... G07C 9/00309 160/188
2003/0102836 A1 * 6/2003 McCall ..... E05F 15/668 318/445
2003/0193304 A1 10/2003 Fitzgibbon
2004/0216379 A1 * 11/2004 Gioia ..... E05F 15/79 49/29
2004/0249513 A1 12/2004 Anderson et al.
2004/0261317 A1 12/2004 Murray
2005/0012631 A1 * 1/2005 Gregori ..... G08B 25/085 340/686.1
2005/0082998 A1 4/2005 Gregori et al.
2005/0122076 A1 6/2005 Patchell et al.
2005/0156547 A1 7/2005 Gregori
2005/0184854 A1 * 8/2005 Mullet ..... G07C 9/00182 340/5.22
2005/0237014 A1 * 10/2005 Murray ..... E05F 15/668 318/280
2006/0138987 A1 6/2006 McMahon
2006/0197481 A1 9/2006 Hotto
2007/0000622 A1 * 1/2007 Reed ..... E05F 15/40 160/188
2007/0001637 A1 1/2007 Murphy et al.
2007/0185597 A1 * 8/2007 Bejean ..... H04L 12/282 700/83
2010/0127882 A1 * 5/2010 Sitarski ..... E05F 15/77 340/686.1
2010/0242369 A1 * 9/2010 Laird ..... E05F 15/684 49/358
2012/0092124 A1 * 4/2012 Fitzgibbon ..... H04B 1/713 340/5.1
2015/0015369 A1 * 1/2015 Lamb ..... E05F 15/77 340/5.71
2015/0084779 A1 3/2015 Saladin
2015/0275564 A1 * 10/2015 Rosenthal ..... E05F 15/668 700/275
2016/0281411 A1 9/2016 Calagaz, Jr.
2016/0300415 A1 * 10/2016 Deneen ..... G07C 9/00571
2018/0160273 A1 * 6/2018 Huggins ..... H04L 67/18
2019/0244448 A1 * 8/2019 Alamin ..... G07C 9/20
2020/0340288 A1 * 10/2020 Ikeler ..... E05F 15/77
2020/0368837 A1 11/2020 Inoue et al.

* cited by examiner

REMOTE MONITORING AND CONTROL OF MOVEABLE BARRIER IN JACKSHAFT DOOR OPERATOR SYSTEM

CROSS REFERENCE TO RELATED APPLICATION

This application claims the benefit of the filing date of U.S. Provisional Application 62/838,052, filed Apr. 24, 2019, the disclosure of which is incorporated herein in its entirety.

TECHNICAL FIELD

The present disclosure relates to the field of remote network monitoring and controlling of the status of a movable barrier, more particularly to the determination of the open/close status of a garage door and the subsequent wireless transmission, via the Internet, of such status to an Internet access device such as a user's handheld Smartphone, and even more particularly, in response to the receipt of such garage door status, the transmission, via the Internet, of a change-door-status command to move the garage door in compliance with such command.

BACKGROUND

Movable barriers, such as upward-acting sectional or single panel garage doors, residential and commercial rollup doors, and slidable and swingable gates, are used to alternatively allow and restrict entry to building structures and property. These barriers are driven between their respective open and closed positions by motors or other motion-imparting mechanisms, which are themselves controlled by barrier moving units, sometimes referred to as "movable barrier operators," and in the specific case of a door, as "door operators," and in the even more specific case of a garage door, as "garage door operators." Garage door operators are effective to cause the DC or AC motor, and accompanying motor drive assembly, to move the associated garage door, typically between its open and closed positions.

Each garage door operator includes a door controller (typically, a microprocessor, microcontroller, or other programmable platform) for processing incoming door commands and generating output control signals to the motor which, in combination with its associated drive assembly, moves the garage door in accordance with the incoming door commands. The incoming door commands, in the past, have been in the form of wired or wireless signals transmitted from interior or exterior wall consoles, or from proximately located hand held or vehicle mounted RF transmitters.

However, with the near ubiquity of the Internet and the proliferation of electronic devices and equipment designed to access the Internet, such as personal computers, cellphones, and Smartphones, systems are currently being designed and implemented in the trade that enable non-proximate, or remote, monitoring and control, via the Internet, of door status. For example, if a homeowner is not in proximity to its residence, and wants to determine whether the garage door the homeowner had intended to close, did in fact close, or whether the garage door it intended to leave open for a workman to enter, had in fact been left open, using one of these systems, the homeowner can, through access to the Internet, remotely monitor the status of the garage door (e.g., whether it is open or closed). Moreover, if the garage door is not in the desired position, these systems are designed to also enable the homeowner to transmit change-door status commands over the Internet to move the garage door to the desired position, all without having to be physically proximate the garage to do so.

These aforestated systems typically use means capable of determining the status of the garage door that is then remotely transmitted to the homeowner. For example, some systems use door status monitoring apparatus affixed to, or proximate, the garage door to directly monitor the garage door status. While this approach is generally acceptable for many applications, the requirement to have separate apparatus affixed to, or proximate, the garage door may, for various reasons, not be the most desired approach. Other systems have indirectly determined door status from the door controller of the garage door operator (i.e., from the microprocessor, microcontroller or other programmable platform of the garage door opener). However, these systems have not been entirely acceptable for all conditions of service.

It is therefore among the objectives of the embodiments of the remote door status monitoring and control system and method disclosed herein to present a new and improved version of such system and method that is reliable, takes advantage of Internet signal transmission, and is convenient to install and use.

SUMMARY

In an example aspect, the present disclosure is directed to a garage door status monitoring and control system. The system may include a control module comprising a programmable platform configured to: receive a change-door-status command to change a position of a door; in response to the change-door-status command, generate and communicate a light or sound command to a wireless controller; delay a period of time after communicating the light or sound command to the wireless fixture controller; and only after the delay, generate a door command corresponding to said change-door-status command to change the position of the door.

In an aspect, the wireless controller may be a Bluetooth microprocessor controllably generating a wireless signal in response to receipt of the light or sound command to wirelessly actuate a remote fixture. In an aspect, the remote fixture may include a microprocessor for wirelessly returning an acknowledge signal indicating receipt of the light or sound command to actuate the remote fixture. In an aspect, the remote fixture may be configured to communicate the acknowledge signal to the wireless controller, and the wireless controller may be configured to communicate the acknowledge signal to the control module. The control module may be configured so that receipt of the acknowledge signal authorizes the control module to generate the door command, and the absence of receipt of the acknowledge signal during the period of time prevents the generation of the door command. In an aspect, the wireless controller may be a Bluetooth controller configured to communicate via a Bluetooth low energy radio link. In an aspect, the remote fixture may comprise a light or sounder. In an aspect, the remote fixture may comprise both a sounder and a light actuatable in response to the wireless signal. In an aspect, the delay in the control module may be in a range between about 1 to 15 seconds. In an aspect, the system may include a door controller in communication with the control module and responsive to the door command to control a motor to change to the status of the garage door. The door controller may also be in communication with the wireless controller and may be configured to generate and communicate a signal to the wireless controller to activate a light on a remote fixture. In an aspect, the control module may further comprise a Wi-Fi transceiver configured to receive the change-door-status command from a remote Internet access device.

In another example aspect, the present disclosure is directed to a method of monitoring status and controlling a garage door with a jackshaft operator. The method may include generating and wirelessly communicating an alert signal from the jackshaft operator to a remote fixture; receiving an acknowledgement at the jackshaft operator from the remote fixture indicating that the remote fixture received the alert signal; in response to receiving the acknowledgement, delaying for a period of time sufficient for the remote fixture to alert observers of imminent movement of the garage door; after delaying for the period of time, generating a door command to change a status of the garage door; and activating a motor of the jackshaft operator to change the status of the garage door.

In an aspect, the method may include receiving a change-door-status command from an internet access device and comparing the change-door-status command to a current position of the garage door. In an aspect, the method may include monitoring a current position of the garage door with an absolute position sensor and communicating the current position to a door control module. The comparing the change-door-status command to the current position of a garage door may be performed by the door control module. In an aspect, the absolute position sensor is operably coupled to an output shaft of the motor. In an aspect, the alert signal is a command for the remote fixture to flash a light or make a sound. In an aspect, generating and wirelessly communicating the alert signal from the jackshaft operator to the remote fixture comprises transmitting the alert signal via a Bluetooth low energy radio link. In an aspect, delaying a period of time comprises delaying between about 1 and 15 seconds. In an aspect, the method may include receiving a change-door-status command from a wall console and in response generating and wirelessly communicating an on-light command from the jackshaft operator to the remote fixture. In an aspect, the method may include comparing a change-door-status command to a current position of a garage door, and generating and wirelessly communicating the alert signal only if the change-door-status command is different than the current position of the garage door.

In another example aspect, the present disclosure is directed to a garage door status monitoring and control system. The system may include a control module to receive garage door position information and to receive a change-door-status command from a remotely located Internet access device. The door control module may comprise a programmable platform configured to: route said garage door position information to a wireless interface for transmission to said Internet access device, and cause said change-door-status command to generate a light or sound command to a Bluetooth controller, as well as generate a door command corresponding to said change-door-status command. The said door command may be delayed a defined period of time after the generation of the light or sound command. The Bluetooth controller may controllably generate a wireless signal in response to receipt of the light or sound command to actuate a remote fixture with light or sounder. The remote fixture may be configured to wirelessly return an acknowledge signal indicating receipt of the light or sound command. The acknowledge signal may be conductively transmitted to the programmable platform, the receipt of which may allow the door command to be generated by the programmable platform, and the absence of which acknowledge signal during the defined period of time preventing the generation of the door command.

In an aspect, the control module is disposed at a jackshaft operator and the remote fixture is remote from the jackshaft operator.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, serve to explain the principles of the present disclosure.

DETAILED DESCRIPTION

Figure 1:
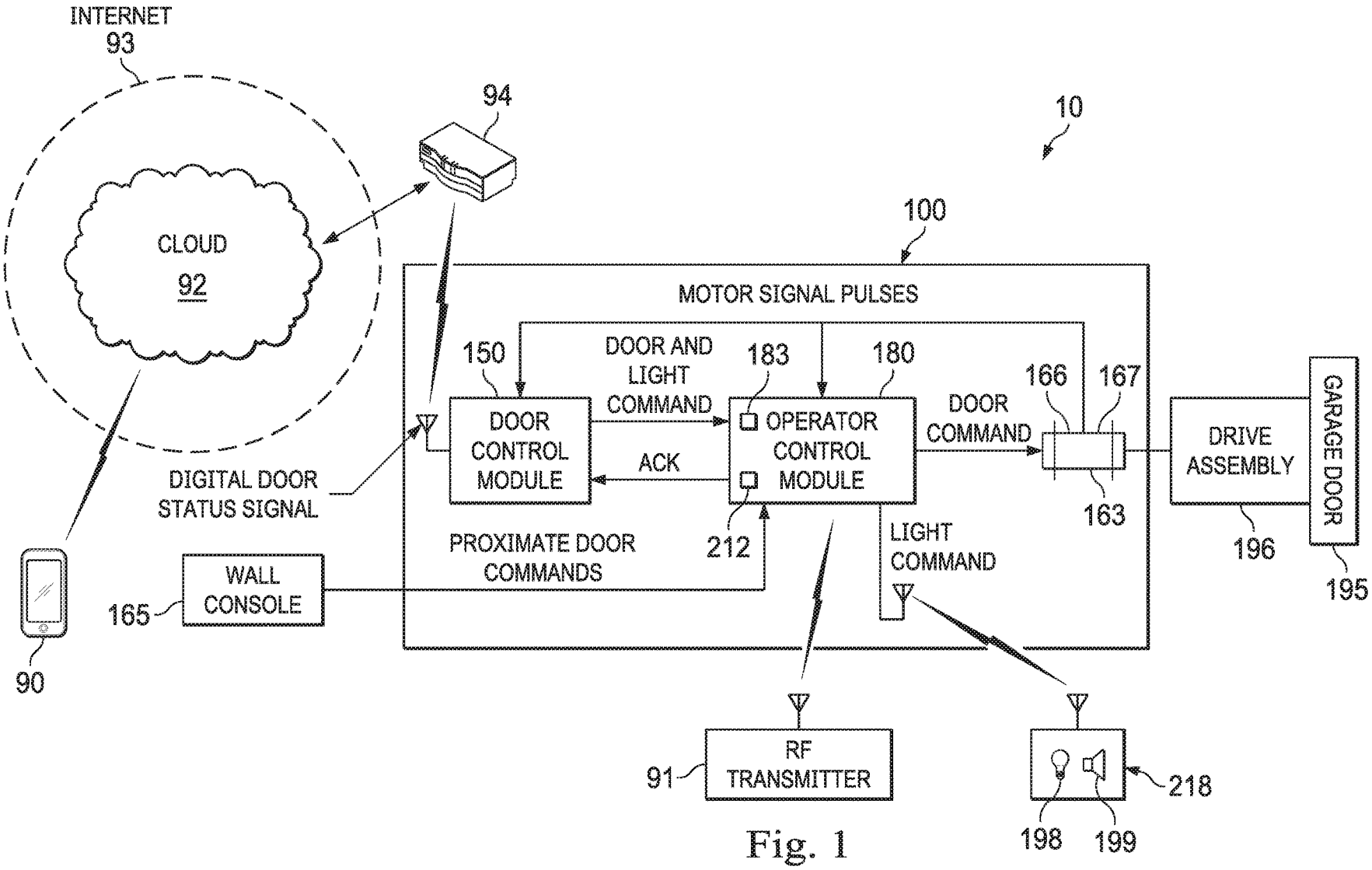
FIG. 1 is a block diagram of an embodiment of the interconnection of the principal components of a remote movable barrier status monitoring and control system in accordance with the principles of the present invention.

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

With initial reference now to FIG. 1, there is depicted a block diagram of the overall process, and interconnection of the principal components of a new and improved remote garage door status monitoring and control system 10, incorporating the principles of the present invention. Accordingly, the system 10 remotely determines and monitors the status (e.g., closed/not closed or open/closed) of the garage door 195 as well as remotely effecting change of the status of such door utilising, in some implementations, a jackshaft garage door operator. Specifically, the system 10 includes a power head chassis 100 that in the example described, is a chassis of a jackshaft operator. The chassis 100 encloses a jackshaft motor assembly 163, a door control module 150, and an operator control module 180. The jackshaft motor assembly 163 includes (i) a motor 167 adapted to move the garage door in the conventional manner known by one of ordinary skill in the industry, and (ii) an absolute position sensor 166 that monitors or measures rotation of a motor shaft of the motor 167 and communicates signals based on the measurements indicative of, the extent and direction of rotation of the rotatable output shaft of motor 167, and therefore indicative of the extent and direction of travel of the garage door 195 between travel limits.

The motor 167 is operatively coupled to a drive assembly 196. The motor 167 and drive assembly 196 are effective to impart movement to the door 195 in accordance with door commands remotely and/or proximately transmitted to operator control module 180 and thereafter to the motor 167. The drive assembly 196 may be any of the standard and conventional drive assemblies available on the market that are suitable to move the garage door 195 in response to motor 167. In the example described herein, the drive assembly 196 is a part of a jackshaft drive assembly.

Figure 4A:
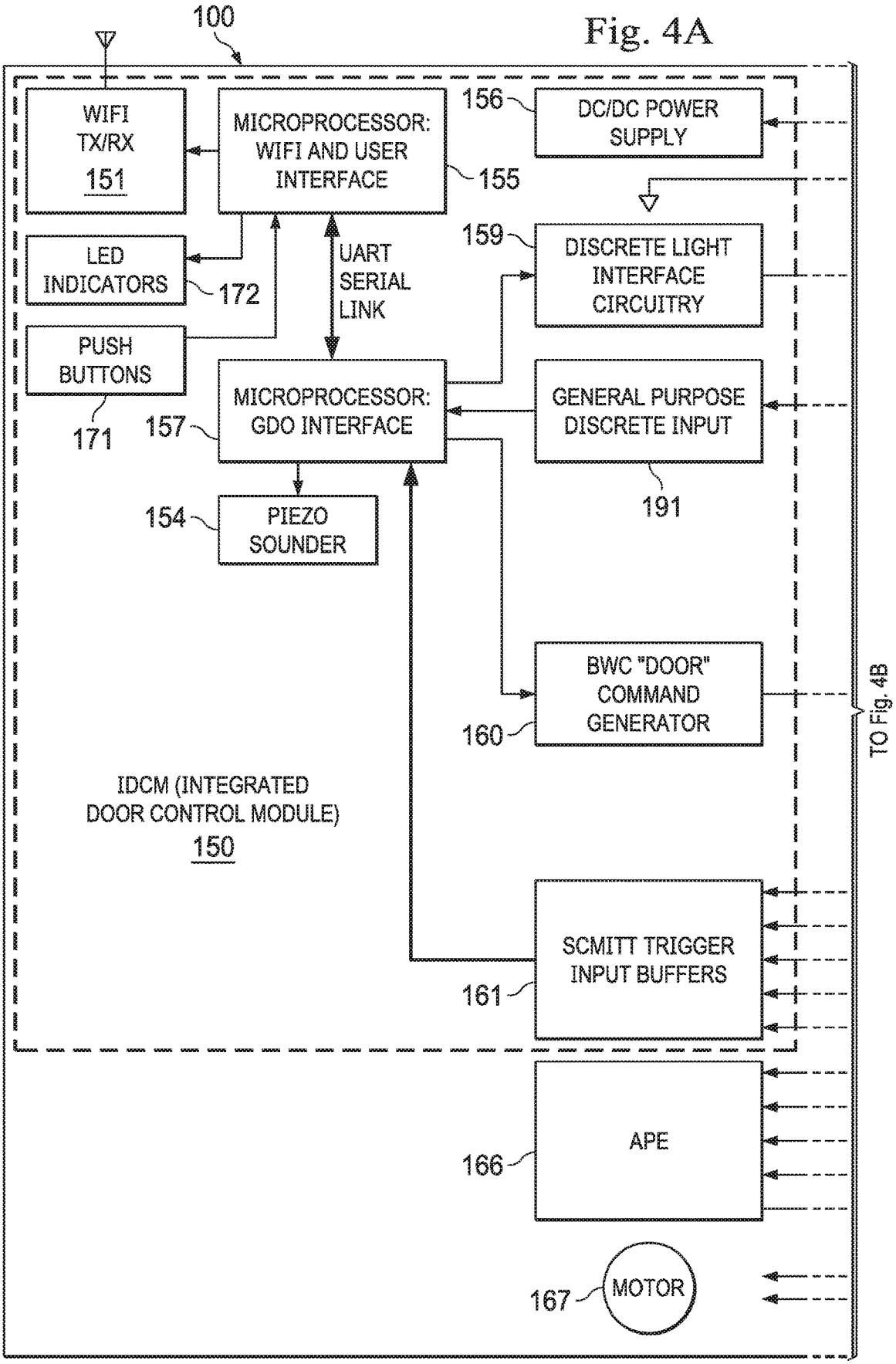
FIGS. 4A and 4B each respectively show a portion, and together show the entirety, of a more detailed schematic block diagram of the remote movable barrier status monitoring and control system of FIG. 1.
Figure 4B:
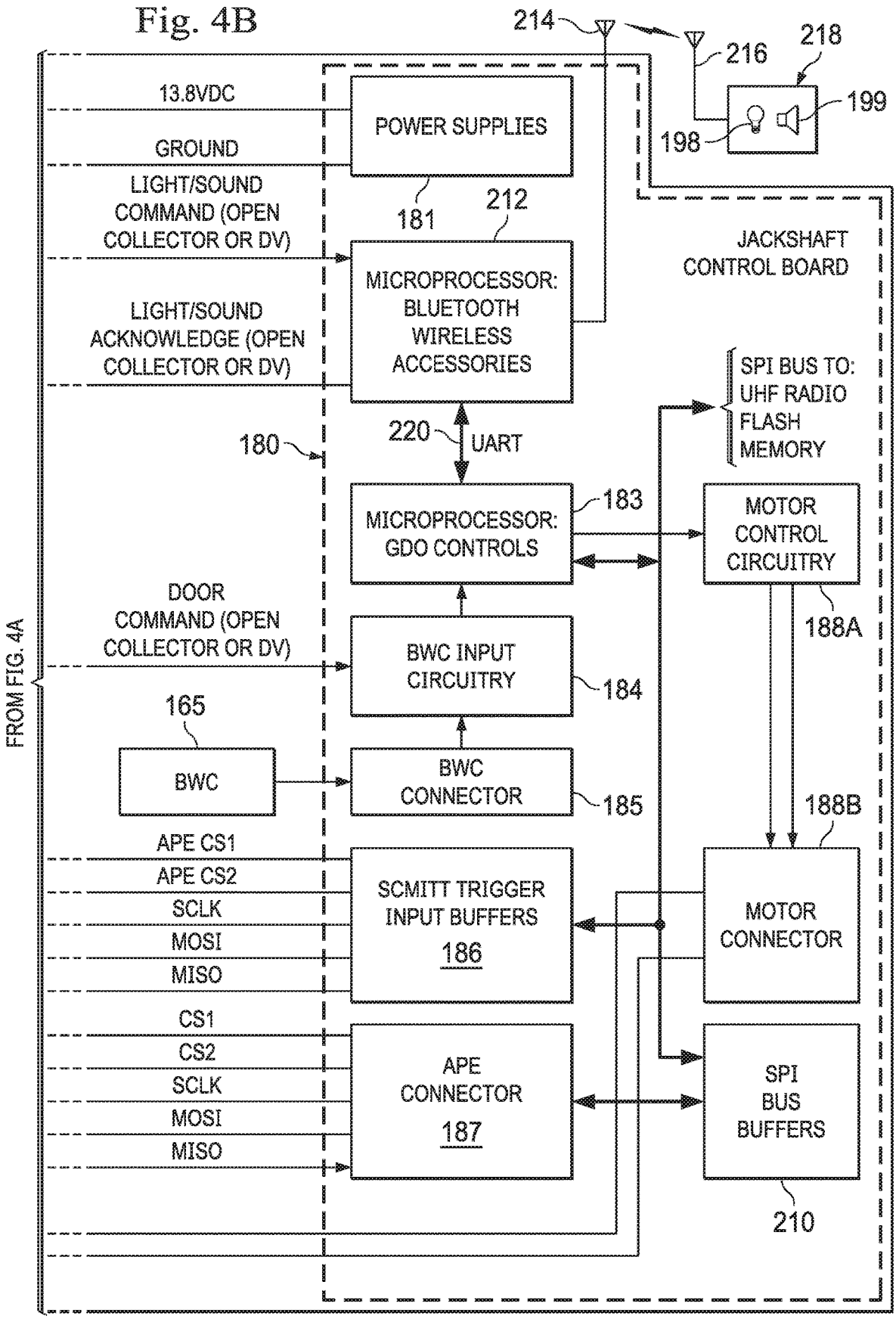

In accordance with the overall operation of the garage door status monitoring and control system 10, information from the absolute position sensor 166 indicative of the extent and direction of motor shaft rotation, and therefore the extent and direction (up or down) of garage door 195, are conductively transmitted by wire to the door control module 150 and the operator control module 180. An example of specific signal routing from the absolute position sensor 166 is shown in FIGS. 4A and 4B.

The door control module 150 includes a microprocessor and memory and is effective to process and convert the incoming motor signal pulses to digital door status signals indicative of the garage door status, for example "open/closed" or "closed/not closed" status, of the garage door 195. This door status information may be then wirelessly transmitted by the door control module 150, via a Wi-Fi home router 94, to (and for storage in) cloud server 92 of the Internet 93, where such status information is subsequently pushed to a Smartphone 90, or any other suitable Internet access device, such as a desktop or laptop computer, personal data assistant (PDA), mobile phone, tablet, or the like, for user review of the then current garage door status. In some examples herein, nowhere in system 10 is door status ever requested, with the door status information always being "pushed" to the next component or stage.

With continuing reference to FIG. 1, the system 10 is also effective to wirelessly transmit a change-door-status command from smartphone 90, via the Internet and cloud server 92, and home router 94, back to the door control module 150. Change-door-status commands may also be initiated from the cloud server 92 in appropriate situations, such as a pre-programmed time-to-close, or other pre-programmed activities.

Upon receipt of the remotely generated change-door-status command, the door control module 150 may be configured to transmit a door command (door position command) and a light/sound command (light or sound command) respectively to a door controller 183 and a remote fixture 218 that may include a work light 198 and/or a sounder 199. More specifically the door control module 150 is configured to transmit the door command to the door controller 183 of the operator control module 180 and to transmit the light/sound command to a wireless controller 212 of the operator control module 180. The wireless controller 212 is a wireless controller for the remote fixture 218. Accordingly, the wireless controller 212 then communicates wirelessly with the remote fixture 218 to activate a visual alert with the work light 198 or an audible alert with the sounder 199.

In accordance with conventional procedure, user-generated door commands, such as toggle open/close commands may also be transmitted to the operator control module 180 from a wall console 165 connected to the operator control module 180 via a connector 185. In this implementation, the door controller 183 may also communicate a light command (such as an on-light command) to the wireless controller 212 to turn on or activate the remote fixture 218, such as the work light 198, simultaneously with the operation of the motor 167. One or more hand-held or vehicle-mounted RF transmitters 91 proximate to the garage door 195 may also transmit door commands to the operator control module 180 in a manner to that of the wall console 165.

Figure 2:
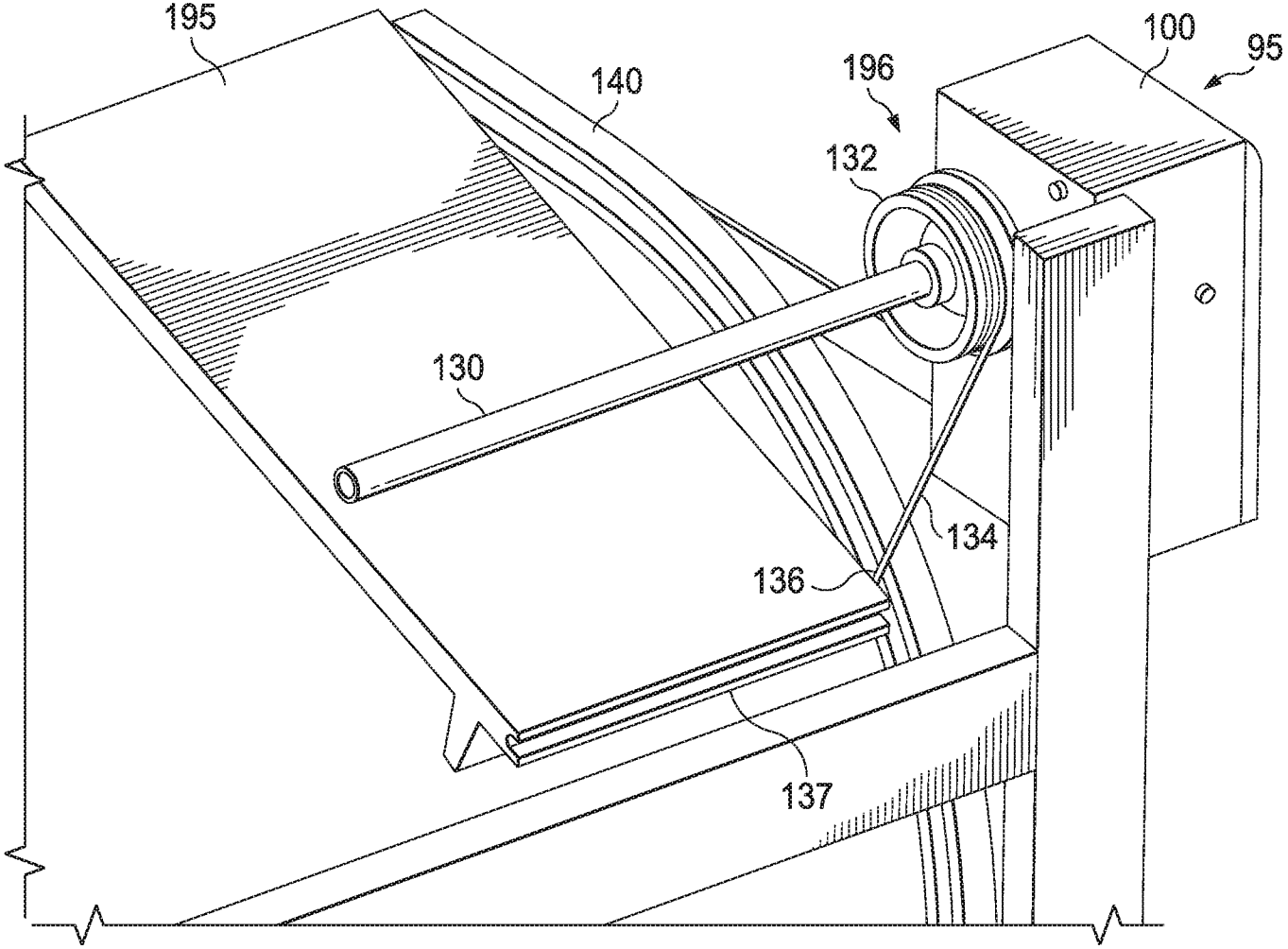
FIG. 2 is perspective illustration of material structural components of a jackshaft motor drive assembly for moving a single panel type garage door.
Figure 3:
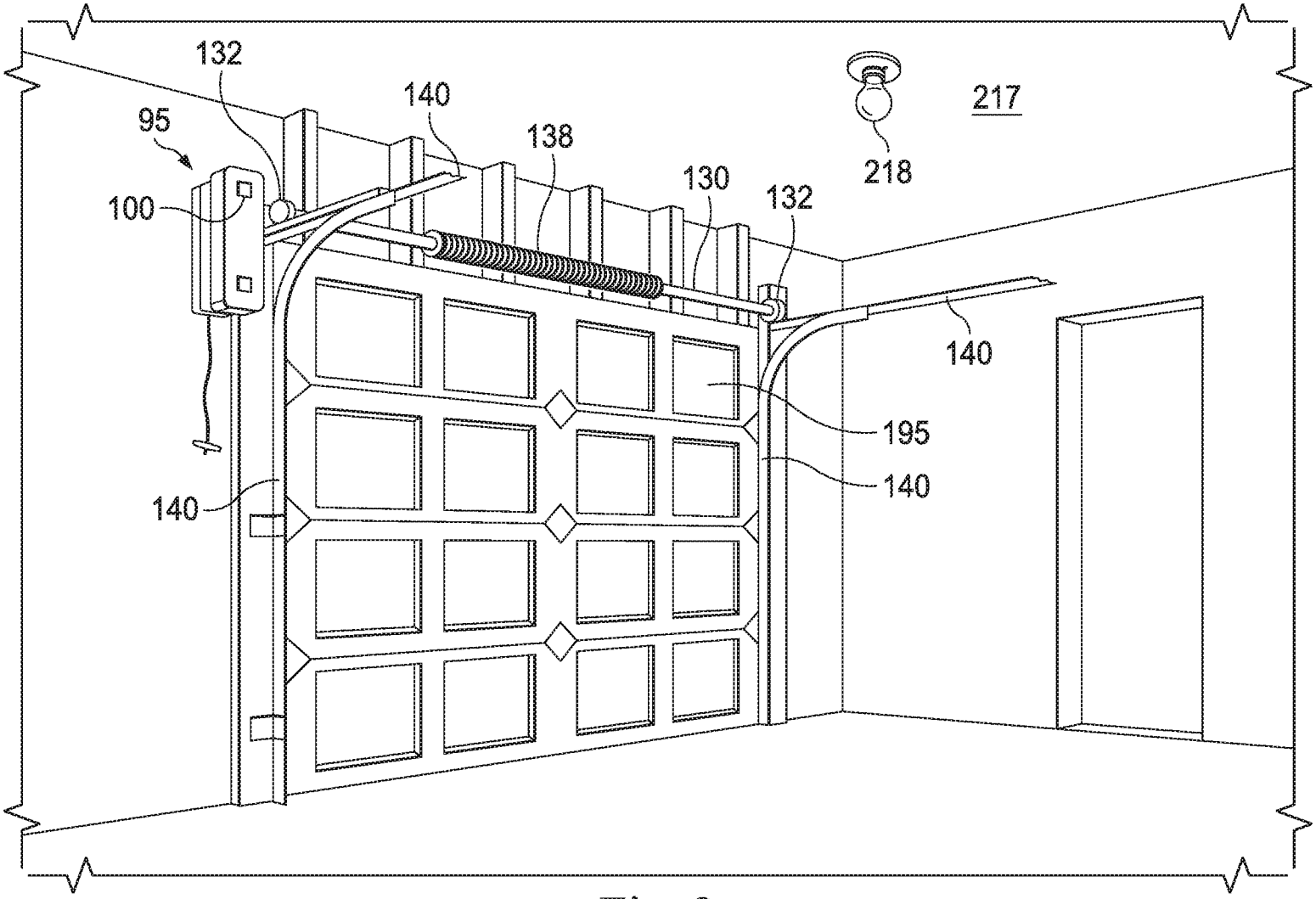
FIG. 3 is a perspective illustration of material structural components of a jackshaft motor drive assembly for moving an upward acting sectional type garage door.

Each of FIGS. 2 and 3 shows an example jackshaft operator 95 including the chassis 100. The jackshaft operator 95 is installed adjacent a garage door 195 and operable to open and close to garage door. The chassis 100 of the jackshaft operator is shown adjacent the motor drive assembly 196 which may include a jackshaft 130 and one or more cable drums 132 rigidly affixed to the jackshaft 130. These may be rotatably driven by the motor 167 of the jackshaft operator 95. One or more cables 134 may be wound about the cable drums 132 and have their free ends 136 attached at or adjacent a bottom edge 137 of the door 195. In some implementations, the jackshaft 130 forms a part of or is coaxial with the motor shaft of the motor 167. In other implementations, the jackshaft 130 may be laterally offset from the motor shaft of the motor 167. Rotation of the output shaft of the motor 167 rotates the jackshaft 130 and the cable drums 132. Rotation in a direction to wind the cable around the cable drums 132 results in the door 195 being raised to the open position.

In this embodiment, the jackshaft 130 of the motor drive assembly 196 extends horizontally and is directly coupled to, and adapted to be rotatably driven by, the motor 167 in either a clockwise or counterclockwise direction. A torsion spring 138 extends around the jackshaft 130.

FIG. 2 illustrates the garage door 195 as a conventional single panel door being moved between open and closed positions along guide rails 140, and FIG. 3 illustrates the garage door 195 as a conventional upward acting sectional door being moved between open and closed positions along guide rails 140. When the motor 167 is instructed by a controller (such as the wall console 165, the RF transmitter 91, or the smartphone 90) to open the door 195, the jackshaft 130 and the connected cable drums 132 are rotated by the motor 167 in a direction so as to wind the cable(s) 134 onto the cable drum(s) 132, thereby lifting the garage door 195 to its open position. When the motor 167 is instructed by the controller to close the door 195, the jackshaft 130 and connected cable drums 132 are rotated by the motor 167 in the opposite direction so that cable(s) 134 may be payed out, thereby permitting the door 195 to be closed. The torsion spring 138 provides a counterbalance to aid in the door 195 being moved to its closed position. Additional details of an example jackshaft drive assembly may be found in U.S. provisional application, Ser. No. 62/662,136, filed Apr. 24, 2018, and its corresponding U.S. application Ser. No. 16/392,214, filed Apr. 23, 2019, which are incorporated herein in their entirety. As described further below, an absolute position sensor (APE) is coupled to the output shaft of the motor 167 or the jackshaft 130.

FIG. 3 also shows that the door 195 provides access to a room having a ceiling 217 and the remote fixture 218 that is spaced from and remote from the jackshaft operator 95. As apparent from the description herein, the jackshaft operator 95 is disposed adjacent the garage door 195, and in the implementation shown, is on the same wall as the opening covered by the garage door 195. Because of the nature of a jackshaft operator, a work light on a jackshaft operator may not be positioned in a location of the room that is convenient for illuminating a large portion of the room or that may be visible from a large portion of the room. Thus, the effectiveness of the light used with a jackshaft operator may be increased by locating the light at a location remote from the jackshaft operator.

In this implementation, the remote fixture 218 is disposed on the ceiling 217 in a location more appropriate for garage lighting. Although FIG. 3 shows the remote fixture 218 located on a ceiling of the room, in other implementations, the remote fixture 218 may be disposed anywhere desired remote from the jackshaft operator 95. In some implementations, the remote fixture 218 is disposed on a wall. In some implementations, the remote fixture 218 is disposed on the room exterior instead of the room interior. In some implementations, the system may include multiple remote fixtures 218 disposed in appropriate locations to signal that operation of the door operator is about to commence. In the implementation shown the remote fixture 218 is a wirelessly-activated remote fixture that includes at least one of the work light 198 and the sounder 199. Some implementations include both the work light 198 and the sounder 199. The remote fixture 218 may be wirelessly activated via a corresponding wireless signal system that may be a part of the operator control module 180. As described herein, the remote fixture 218 is wirelessly activated using a local network such as a Bluetooth network, although other local wireless communication methods may be used.

Depending upon the implementation, the remote fixture 218 may be powered from a 120V AC main but may be controlled through a Bluetooth low energy (BLE) radio link to the jackshaft operator 95. Since the door control module 150 is integral to the jackshaft chassis 100, the door control module 150 does not have direct access to the light control circuitry. Accordingly, the door control module 150 signals the remote fixture 218 (with, for example an alert signal or an on-light signal or off-light signal) by providing a discrete output directly to the Bluetooth low energy radio link on the operator control module 180, which will pass this signal onto the remote fixture 218.

Although the jackshaft operator 95 may include an onboard sounder, its location and orientation in an installed jackshaft operator may render its output noncompliant or less effective than if were disposed in a more suitable location, such as a central location. To accommodate, the remote fixture 218 may include the sounder 199, which may be installed in a more favorable location and orientation. The same discrete output that controls the work light 198, in a similar manner, may also control the sounder 199.

FIGS. 4A and 4B provides a detailed schematic block diagram of an example embodiment of the garage door monitoring and control system 10 located within the power head chassis 100 of the jackshaft operator 95. For clarity of presentation, the detailed schematic block diagram has been broken into two adjacent portions, namely FIG. 4B primarily depicting, at the right side of the block diagram, the components of the operator control module 180, and FIG. 4A primarily depicting, at the left side of the block diagram, the components of the door control module 150.

FIGS. 4A and 4B detail elements of the remote movable barrier status monitoring and control system 10 in greater detail than in FIG. 1, including the power head chassis 100. As discussed above, and as shown FIGS. 4A and 4B, the jackshaft motor assembly 163 (FIG. 4A) includes (i) the motor 167, which in this embodiment is a DC motor, and (ii) the absolute position sensor (APE) 166. The APE 166 in this embodiment may be an absolute position encoder. The APE 166 may be of any design effective to generate signals indicative of the extent and direction of rotation of the output shaft of motor 167, and therefore the extent and direction of travel between limits of the garage door 195. In an example implementation, the APE 166 is coupled to the output shaft of the motor 167 or the jackshaft 130 (FIG. 2) connected to the door 195. In some implementations, the APE 166 is an absolute position encoder that typically digitally determines the angles of two gears with different tooth counts, providing a fine and a coarse position reading that is combined to determine the absolute position of the monitored shaft. A microprocessor 157 of the door control module 150 may receive signals from the APE 166 and may arithmetically combine the angle values and the rotational position of the motor output shaft or jackshaft to determine the door position between the preset upper limit and the preset closed limit. In an example implementation, the APE 166 includes a first gear wheel having 30 teeth and a second gear wheel having 29 teeth, which are directly coupled to one another. The output shaft of the motor 167 or the jackshaft itself may include a 60-tooth gear on it which drives the gear train integral to the APE. Each of the first and second gears has a magnet in a fixed orientation, permanently attached to it such that the magnet rotates with the gear. The electronics in the APE 166 are based around the pair of hall effect angle sensors that measure the angular displacement of each magnet in the sensor.

The power head chassis 100 of the jackshaft operator notably allows for manual operation of the door after activation of a manual release (pull cord not shown). An advantage of the APE in this application is that the system also detects manual operation of the door between the preset upper limit and the preset closed limit and pushes the door status to the cloud without activation of the motor control. This feature is different from trolley operators with similar integrated Wi-Fi control modules, which do not detect manual operation of the door if the trolley is manually released. That is, because the APE is disposed on or operably coupled to the output shaft of the motor, which is directly correlated with the jackshaft rotation, the position of the door can be determined whether the motor is powered or now. Because the APE detects the absolute position of the door, the system can additionally identify a change in door status during a power outage once power is restored. That is, if the homeowner opens the door by manual release while power is out, and leaves it open, when power is restored, the system will push the change to the cloud, enabling the smartphone 90 to convey accurate information to the user.

Also, it is worth noting that in the implementation shown, the APE is shared by the operator control module 180 and the Wi-Fi door control module 150. This arrangement may provide a cost and manufacturing efficiency over using separate encoders for each of the operator control module 180 and the Wi-Fi door control module 150.

As illustrated in FIGS. 4A and 4B, the APE 166 generates an electrical motor signal from the hall effect sensors. The signal represents the position of the door 195 between its limits and are routed to the door control module 150. In the example shown, the signal is subsequently routed via an APE connector 187 through SPI Bus Buffers 210. In this implementation, the SPI is a multi-drop synchronous serial communications bus in a dominant/subordinate configuration, meaning that one dominant device on the bus will initiate all data transactions, while all other devices (subordinate devices) will send and receive data in response to requests from the dominant device. The SPI Bus connects the APE 166 with the SPI Bus Buffers 210 and with a door controller 183 forming a part of the operator control module 180. The signals from the APE 166 however may be directed to and through input buffers 186 and, in turn, as electrical pulses which are routed through input buffers 161 of door control module 150 (FIG. 4A).

With continuing reference to FIG. 4A, the buffered electrical pulses from input buffers 161 are routed to the microprocessor 157 on the door control module 150. In accordance with the technique subsequently described, these electrical signals are then processed, preferably by programmable-controlled operation, by the microprocessor 157 (or other programmable platform) to produce digital door status signals indicative of the status of the garage door 195 (e.g., "open or closed" or "closed or not closed"). The so-generated digital door status signals are then transmitted from microprocessor 157, by way of a UART serial link, to a microprocessor 155 (in direction of upwardly pointed arrow) for initial storage and Wi-Fi conditioning, and thereafter transmission to Wi-Fi transceiver 151, where the Wi-Fi door status information is subsequently wirelessly transmitted, as previously described, via the Internet, to the cloud server 92 and smartphone 90 (FIG. 1). Push buttons 171 and LED indicators 172 may allow user interface with the microprocessor 155.

The Wi-Fi transceiver 151 of door control module 150 is effective to receive any remotely generated change-door-status commands from the smartphone 90 or other internet access device. This may be routed to the microprocessor 155. After the change-door-status command is compared with the actual door status information previously stored in microprocessor 155 to assure that the change-door-status command is not the same as the previously stored status, the incoming change-door-status command is then routed by microprocessor 155 (in direction of downwardly pointed arrow) to the microprocessor 157.

In response to receiving the change-door-status command, the microprocessor 157 is configured to actuate the door command generator 160 of the door control module 150 to generate a door command to change the door status, such as to raise or lower the door. The door command is communicated from the door command generator 160, and via the input circuitry 184 of the operator control module 180 (FIG. 4B), to the door controller 183 of the operator control module 180. The door controller 183 may store travel limits therein for the garage door 195. The door controller 183 then, via motor controller circuitry 188*a* and motor connector 188*b*, instructs the motor 167 to move the garage door in compliance with the door command.

In implementations described herein, prior to the microprocessor 157 initiating sending of the door command to the door controller 183, the microprocessor 157 activates the piezo sounder 154 and/or the light interface circuitry 159 to respectively sound the on-board sounder 154 (such as with a buzzer) and/or flash the work light 198 or activate the sounder 199 of the remote fixture 218, to warn anyone near the garage door 195 of the unattended imminent movement of the garage door 195.

When the microprocessor 157 activates the light interface circuitry 159, the light interface circuitry 159 communicates a light/sound command from the door control module 150 to a wireless controller 212, and the wireless controller 212 communicates an actuation signal, such as an alert signal, via an antenna 214 to an antenna 216 of the remote fixture 218. In an example, the wireless controller 212 is a Bluetooth microprocessor and the remote fixture 218 is a Bluetooth fixture with a work light 198 and a sounder 219. The actuation signal (alert signal or on-light signal) provides actuation of the work light 198 and the sounder 199. Confirmation of receipt of the actuation signal (irrespective of whether the work light is actually illuminated or the sounder makes a noise) is wirelessly transmitted as a light/sound acknowledgement (acknowledge signal) by the remote fixture 218 back to the wireless controller 212 via the antennas 216 and 214. The light/sound acknowledgment is conductively transmitted by the wireless controller 212 to the microprocessor 157 of the door control module 150 for the purpose subsequently to be described.

As described herein, after receiving the light/sound acknowledgment, the microprocessor 157 executes a delay for a defined time period. The delay allows the work light 198 and the sounder 199 to warn bystanders of the forthcoming unattended movement of the barrier (garage door) before the door is commanded to move. In some embodiments, the defined time period is between about 1 and 15 seconds, and in some embodiments, between about 1 and 6 seconds. Time periods greater than 15 seconds are also contemplated. Some implementations do not employ a defined time period of delay.

After the delay, the microprocessor 157 is configured to instruct the door command generator 160 to generate the door command to be sent to the operator control module 180 to activate the motor and move the door. The door command generator directs the door command to input circuitry 184 and the door controller 183.

If, after generating the light/sound command, the microprocessor 157 fails to receive the light/sound acknowledgement with the defined time period (i.e., there is an absence of an acknowledgement that the remote fixture 218 has been actuated), the microprocessor 157 is configured or programmed to not initiate generation or transmission of the door command. Thus, this feature acts as a failsafe that the unattended door movement of the garage door 195 will not occur without confirmation that the light and sounder remote fixture 218 has been actuated. Accordingly, when the microprocessor 157 receives the command to move the door 195, an annunciation period begins, during which the piezo sounder 154 and the remote fixture 218 (such as a flashing light 198) are activated at the rate and duration in compliance with UL325 requirements. After this annunciation period has expired, the microprocessor 157 then transmits the door command to the door controller 183.

In some implementations, the smartphone 90 (FIG. 1) comprises one or more apps that may be utilized to generate door command signals or receive status information via the Internet from the door control module 150. As described herein, the smartphone 90 may communicate directly with the Wi-Fi transceiver 151. However, when the smartphone is local and in range, the smartphone may communicate directly with the Bluetooth antenna 214 to direct commands from a user to raise the garage door 195, lower the garage door 195, activate the remote fixture light or sounder, or perform other functions of the system 10. When a command signal is communicated via the Bluetooth antenna 214, the command signal may be routed through the wireless controller 212 to the door controller 183, via the UART 220. Upon receiving this command signal, the door controller 183 may generate command signals that are passed to the motor control circuitry 188*a*, the motor connector 188*b*, and ultimately to the motor 167 to control the garage door 195. Thus, since the initiated activated signal from the smartphone 90 is necessarily local (e.g., utilizing short-range signal protocols like Bluetooth), the delay period may be unnecessary since the user presumably is in the same proximity as the door. Thus, the signals are not routed to the door control module 150 are not delayed. That is, the door controller 183 may activate the door status change without the warning of a flashing light or buzzer. However, when the initiated activation signal is obtained over Wi-Fi and routed through the microprocessor 157 of the door control module 150, the delay may be utilized to warn nearby individuals that the door movement is imminent.

The processing of the motor signal from the APE 166 may be in accordance with programmable software executed by microprocessor 157. For example, the processing algorithms of such software may be directed to reliably performing the task of determining the location of the close limit and tracking position to determine when the garage door is in sufficient proximity to that close limit to declare the door as being "closed." All other detected positions of the door may then be declared as "not closed", or "open." Thus, the microprocessor 157, under control of the algorithm of the software, may infer, from the motor signal inputs, that it has run in one direction for a predetermined minimum time and then stopped, that the door is away from the other limit. Therefore, if the door runs upwardly and then stops, the determination is that it is not at the close limit. Another algorithm may then be used to confirm that finding. Thus, microprocessor 157, under control of that algorithm, may record that the minimum and maximum positions that are detected are the working limits. An example of a suitable absolute position sensor that can be used to generate a signal is described in U.S. Pat. No. 8,113,263, to Reed et al., issued Feb. 14, 2012, and entitled Barrier Operator With Magnetic Position Sensor, which is incorporated herein by reference in its entirety.

Figure 5:
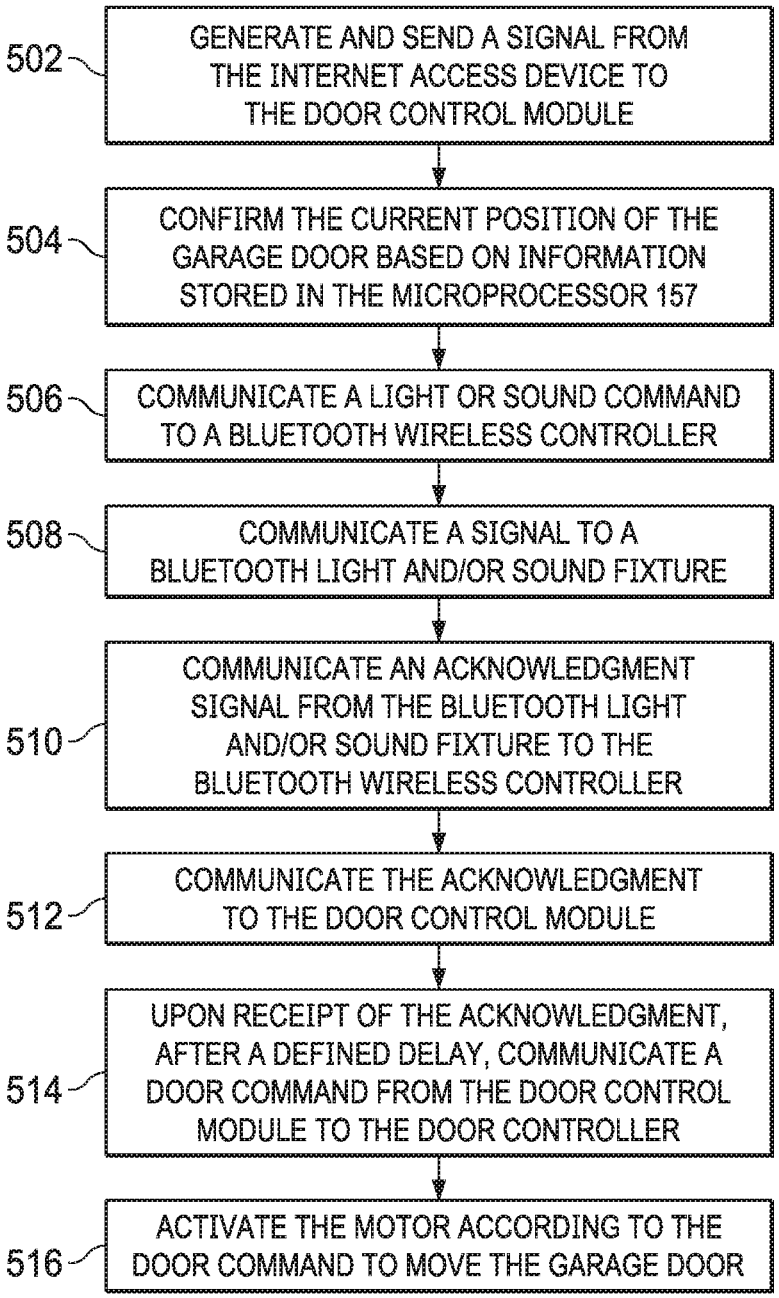
FIG. 5 is a flow-chart of a method for monitoring or controlling a jackshaft remote moveable barrier system

FIG. 5 is a flow chart showing an example method 500 of a portion of operation of system 10, and in particular, activation of a remote fixture in response to a signal from an internet access device, such as the smartphone 90.

At 502, a user may select or direct the Internet access device to generate and send a signal to the jackshaft operator 95. In some implementations, the signal may be a command to either open or close the garage door. In some implementations, the user may utilize an app particularly configured to communicate with a particular associated garage door system. The signal from the Internet access device may be communicated as described herein to the door control module 150.

At 504, in response to receiving the signal from the Internet access device, the door control module 150 may confirm the current position of the garage door based on information stored in the microprocessor 157. Here, the signal from the Internet access device may be a command to change the status of the garage door (e.g., a change-door-status command to open the garage door from a closed position or close the garage door from an open position). Confirming the current position of the garage door may include comparing the commanded action to the current status of the garage door. If the commanded action is different than the current status, the door control module 150 may take action to carry out the change-door-status command as described herein.

In response to determining that the current position of the garage door is different than the command from the Internet access device, the system 10 prepares to carry out the command. At 506, the microprocessor 157 of the door control module 150 first communicates the light/sound command to the wireless controller 212. In the implementation of FIGS. 4A and 4B, the wireless controller 212 is a part of the operator control module 180. At 508, in response to receiving the light/sound command from the microprocessor 157 of the door control module 150, the wireless controller 212 generates and transmits a wireless activation command to a remotely located light and/or sound remote fixture 218. The wireless activation command may activate the remote fixture 218 to give notice, via a warning such as a visual or audible signal, in the environment surrounding the garage door. In the example implementations described herein, the warning may be activation of the work light 198 or activation of a sounder 199. In some implementations the work light 198 may flash for a period of time and/or the sounder 199 may emit an audible noise, such as a buzzer or voice warning, thereby alerting anyone within the environment surrounding the garage door that unattended garage door movement is imminent. Thus, a person standing adjacent the garage door may be alerted that the garage door is about to move according to a remotely generated change-door-status command.

At 510, the remote fixture 218 may communicate the light/sound acknowledgement back to the wireless controller 212. In some implementations, the remote fixture 218 may communicate the light/sound acknowledgement back to the wireless controller 212 immediately after receipt of the activation command. Thus, the receipt may not be contingent upon the remote fixture being activated, but instead may be contingent only upon the light/sound command having been received at the remote fixture 218. As such, if the work light 198 were a burned-out bulb, the receipt would still be acknowledged by the remote fixture. In other implementations, the remote fixture 218 may communicate the light/sound acknowledgement back to the wireless controller 212 only after carrying out the visual or audible warning.

At 512, the wireless controller 212 may communicate the acknowledgment to the door control module 150. In some implementations, the acknowledgment may be transmitted to a general purpose discrete input 191 to the microprocessor 157 on the door control module 150.

At 514, upon receipt of the light/sound acknowledgement, the microprocessor 157 may activate the time delay for the preestablished amount of time. As described herein, the preestablished amount of time may be several seconds, and in some embodiments, may be in the range of about 1 to 15 seconds. This delay may provide time for persons located in the proximity of the garage door to take action to move away from the garage door before it begins movement. After the defined delay, the microprocessor 157 may instruct the door commanded generator 162 generate and communicate a door command, which may be communicated from the door control module 150 to the door controller 183 on the operator control module 180.

The door controller 183 of the operator control module 180 may receive the door command through input circuitry 184 and may execute the command by activating the motor according to the door command to move the garage door, at 516. Accordingly, persons in the vicinity of the garage door may receive sufficient warning that the garage door is about to move, even when activated by someone not in the proximity of the garage door.

As described herein, a user may also activate the garage door from a location proximate to the jackshaft operator 95. In such implementations, the door command may be received from an RF transmitter, communicated along the bus to the door controller 183, which may carry out the command. Likewise, the door command may be received from a Bluetooth enabled device, such as the smartphone 90, via the Bluetooth antenna 214 and the wireless controller 212. In these instances, the door controller 183 may receive the signals and carry out the door commands without the delay because the user initiating the command is in the general proximity of the door, and presumably can notify nearby observers or visually observe sufficient door clearance.

Likewise, the door controller 183 may communicate via the UART with the wireless controller 212 and may turn on the work light 198 of the remote fixture 218 automatically in response to receipt of a door command. Thus, the same remote fixture 218 may be used as a warning, and also as a work light.

Figure 6:
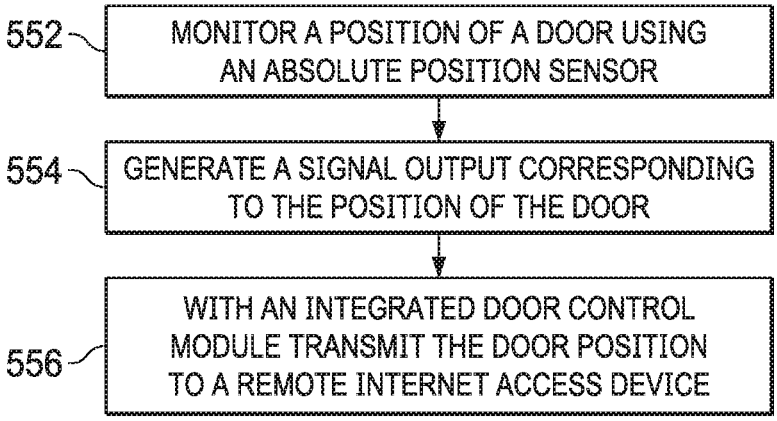
FIG. 6 is a flow-chart of a method for monitoring or controlling a jackshaft remote moveable barrier system These Figures will be better understood by reference to the following Detailed Description.

FIG. 6 is a flowchart showing another method 550 of a portion of operation of the system 10. In accordance with the method 550, a current position of the door 195 may be monitored using the APE at 552. As described herein, in some implementations, the APE may include second and second gears having a different number of teeth, carrying magnets movable relative to piezoelectric sensors. The relative location of the gears may be calculated to determine the status and position of the door relative to preestablished limits.

At 554, the APE may generate an output signal corresponding to the position of the door and communicate that position to the microprocessor 157 of the door control module 150. At 556, the microprocessor may communicate the door position to a remote Internet access device. It may do this by transmitting the door status signal to a microprocessor 155, in communication with the Wi-Fi transceiver 151. The Wi-Fi transceiver 151 may communicate via a network, such as the Internet to an Internet accessible device such as a smartphone 90.

In some implementations, the door status is stored on the smartphone 90, and any changes to door status are automatically pushed to the smartphone 90, so that the smartphone 90 is up-to-date as to the status. In some implementations, because the smartphone 90 has up-to-date information on the status, the comparison (as described herein) of a door command to the status of the door in the microprocessor 157, may be unnecessary.

Various modifications may be made to the disclosed embodiments without departing from the principles of the present invention. For example, while the specific examples set forth above describe transmitting the door status information or transmitting the change-door-status command, via a separate Wi-Fi home router 94, it should be understood that this is a non-limiting example, and the router 94 may alternatively be part of the Internet 93.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A garage door status monitoring and control system, comprising:

a control module comprising a programmable platform configured to:

receive a change-door-status command to change a position of a door;

in response to the change-door-status command, generate and communicate a light or sound command to a wireless controller;

receive an acknowledge signal from a remote fixture indicating that the remote fixture received the light or sound command;

activate a delay of a defined period of time in response to receiving the acknowledge signal, the defined period of time sufficient for the remote fixture to alert observers of imminent movement of the door; and only after the defined period of time, generate a door command corresponding to said change-door-status command to change the position of the door.

2. The system of claim 1, wherein the wireless controller is a Bluetooth microprocessor controllably generating a wireless signal in response to receipt of the light or sound command to wirelessly actuate a remote fixture.

3. The system of claim 2, wherein the remote fixture comprises a microprocessor for wirelessly returning the acknowledge signal indicating receipt of the light or sound command to actuate the remote fixture.

4. The system of claim 3, wherein the remote fixture is configured to communicate the acknowledge signal to the wireless controller, and the wireless controller is configured to communicate the acknowledge signal to the control module, and wherein the control module is configured so that receipt of the acknowledge signal authorizes the control module to generate the door command, and the absence of receipt of the acknowledge signal during the defined period of time prevents the generation of the door command.

5. The system of claim 2, wherein the wireless controller is a Bluetooth controller configured to communicate via a Bluetooth low energy radio link.

6. The system of claim 2, wherein the remote fixture comprises a light or sounder.

7. The system of claim 6, wherein the remote fixture comprises both a sounder and a light actuatable in response to the wireless signal.

8. The system of claim 1, wherein the defined period of time is in a range between about 1 to 15 seconds.

9. The system of claim 1, comprising a door controller in communication with the control module and responsive to the door command to control a motor to change to the status of the door, the door controller also being in communication with the wireless controller and configured to generate and communicate a signal to the wireless controller to activate a light on a remote fixture.

10. The system of claim 1, wherein the control module further comprises a Wi-Fi transceiver configured to receive the change-door-status command from a remote Internet access device.

11. A method of monitoring status and controlling a garage door with a jackshaft operator, comprising:

generating and wireles sly communicating an alert signal from the jackshaft operator to a remote fixture;

receiving an acknowledgement at the jackshaft operator from the remote fixture indicating that the remote fixture received the alert signal;

in response to receiving the acknowledgement, execute a delay for a defined period of time sufficient for the remote fixture to alert observers of imminent movement of the garage door;

after the defined period of time has elapsed, generating a door command to change a status of the garage door; and activating a motor of the jackshaft operator to change the status of the garage door.

12. The method of claim 11, comprising receiving a change-door-status command from an internet access device and comparing the change-door-status command to a current position of the garage door.

13. The method of claim 12, comprising monitoring a current position of the garage door with an absolute position sensor and communicating the current position to a door control module, wherein comparing the change-door-status command to the current position of a garage door is performed by the door control module.

14. The method of claim 13, wherein the absolute position sensor is operably coupled to an output shaft of the motor.

15. The method of claim 11, wherein the alert signal is a command for the remote fixture to flash a light or make a sound.

16. The method of claim 11, wherein generating and wirelessly communicating the alert signal from the jackshaft operator to the remote fixture comprises transmitting the alert signal via a Bluetooth low energy radio link.

17. The method of claim 11, wherein delaying a period of time comprises delaying between about 1 and 15 seconds.

18. The method of claim 11, comprising receiving a change-door-status command from a wall console and in response generating and wireles sly communicating an on-light command from the jackshaft operator to the remote fixture.

19. The method of claim 11, comprising comparing a change-door- status command to a current position of a garage door, and generating and wirelessly communicating the alert signal only if the change-door-status command is different than the current position of the garage door.

20. A garage door status monitoring and control system, comprising:

a control module to receive garage door position information and to receive a change-door-status command from a remotely located Internet access device, said control module comprising a programmable platform configured to:

route said garage door position information to a wireless interface for transmission to said Internet access device; and cause said change-door-status command to generate a light or sound command to a Bluetooth controller, as well as generate a door command corresponding to said change-door-status command, said door command being delayed by the programmable platform by initiating a delay of a defined period of time elapsing from receipt of an acknowledge signal from a remote fixture;

the Bluetooth controller controllably generating a wireless signal in response to receipt of the light or sound command to actuate the remote fixture with a light or sounder, the remote fixture configured to wirelessly return the acknowledge signal indicating receipt of the light or sound command, and the acknowledge signal conductively transmitted to the programmable platform, the receipt of the acknowledge signal allowing the door command to be generated by the programmable platform after expiration of the defined period of time, and the absence of receipt of the acknowledge signal during the defined period of time preventing the generation of the door command by the programmable platform.

21. The system of claim 20, wherein the control module is disposed at a jackshaft operator and the remote fixture is remote from the jackshaft operator.

* * * * *